United States Patent [19]

Ishige et al.

[11] Patent Number: 4,988,614

[45] Date of Patent: Jan. 29, 1991

[54] SILVER HALIDE COLOR PHOTOGRAPHIC LIGHT-SENSITIVE MATERIAL CONTAINING NOVEL MAGENTA COUPLERS

[75] Inventors: Osamu Ishige; Hidetaka Ninomiya; Toyoaki Masukawa; Junichi Kohno, all of Hino, Japan

[73] Assignee: Konica Corporation, Tokyo, Japan

[21] Appl. No.: 409,928

[22] Filed: Sep. 20, 1989

[30] Foreign Application Priority Data

Sep. 27, 1988 [JP] Japan ..... 63-239667

[51] Int. Cl.[5] ..... G03C 7/34

[52] U.S. Cl. ..... 430/552; 430/553; 430/386; 430/387

[58] Field of Search ..... 430/386, 387, 552, 553

[56] References Cited

U.S. PATENT DOCUMENTS

| | | | |
|---|---|---|---|
| 2,569,906 | 10/1951 | Starke | 430/386 |
| 3,222,176 | 12/1965 | Jaeken | 430/552 |
| 3,938,995 | 2/1976 | Gompf et al. | 430/553 |
| 4,009,035 | 2/1977 | Kojima et al. | 430/552 |
| 4,200,466 | 4/1980 | Fujiwhara et al. | 430/552 |
| 4,525,451 | 6/1985 | Ohki et al. | 430/553 |
| 4,567,134 | 1/1986 | Koboshi et al. | 430/552 |

FOREIGN PATENT DOCUMENTS

| | | |
|---|---|---|
| 2502820 | 7/1975 | Fed. Rep. of Germany . |
| 2644195 | 4/1977 | Fed. Rep. of Germany . |

OTHER PUBLICATIONS

*The Theory of the Photographic Process,* James, 4th Edition, p. 338.

*Primary Examiner*—Paul R. Michl
*Assistant Examiner*—Lee C. Wright
*Attorney, Agent, or Firm*—Jordan B. Bierman

[57] ABSTRACT

A silver halide photographic light-sensitive material containing a novel magenta dye-forming coupler. The coupler is represented by the following Formula I:

(I)

wherein $R_1$ is a hydrogen atom or a substituent; $R_2$ is a substituted or unsubstituted aryl group, a substituted or unsubstituted alkyl group, a substituted or unsubstituted heterocyclic group or a substituted or unsubstituted amino group; provided, $R_1$ and $R_2$ are allowed to bond together so as to complete a ring; Z is a hydrogen atom or a group capable of being split off upon coupling reaction with the oxidized product of a an aromatic primary amine developing agent; and EWG is an electron attractive group having a Hammet's $\sigma$ p value of more than 0.3. The photographic material has excellent color reproducibility and improved in color forming efficiency and graininess of images.

6 Claims, No Drawings

SILVER HALIDE COLOR PHOTOGRAPHIC LIGHT-SENSITIVE MATERIAL CONTAINING NOVEL MAGENTA COUPLERS

FIELD OF THE INVENTION

This invention relates to a silver halide color photographic light-sensitive material containing novel magenta couplers and, particularly, to a silver halide color photographic light-sensitive material which is excellent in color reproducibility and is capable of obtaining an excellent graininess.

BACKGROUND OF THE INVENTION

As for a color reproduction system for making color photographs, a subtractive color system has generally been used. The subtractive color system is to obtain a color image in such a manner that yellow, magenta and cyan dyes are each formed upon coupling reaction of couplers with the oxidized products of a color developing agent produced when silver halides are reduced, by making use of a color developer, in each of blue-sensitive, green-sensitive and red-sensitive emulsion layers which are exposed imagewise to light.

As a magenta color-image forming coupler, a 5-pyrazolone type coupler has popularly been put to practical use and the wide ranging studies thereof have been made so far. However, the dyes formed of the 5-pyrazolone type couplers have caused degradation of color purity, because they have had a undesirable absorption having in the blue region of the spectrum.

To solve the above-mentioned disadvantage, there have been the proposals of various types of couplers such as those of the pyrazolobenzimidazole type, indazolone type, pyrazolotriazole type, pyrazolopyrazole type, and pyrazolotetrazole type.

In fact, the dyes formed of those proposed couplers have been preferable from the viewpoint of color reproduction. In recent years, therefore, pyrazoloazloe type couplers have been put to practical use.

This type of couplers are, however, expensive in production cost and not so satisfactory in characteristics from the viewpoints of color forming efficiency and graininess. It has, therefore, been desired to improve these disadvantages.

On the other hand, there have been well-known compounds, as is described in, for example, Angew. Chem. Int. Ed. Eng (2) (1983) 191–209. The Theory of The Photographic Process 4 Ed p338. such compounds are capable of reacting with the oxidized products of a developing agent to form an azine dye through a cyclization-reaction so that magenta color may be developed. Such compounds are preferable from the viewpoint of color reproduction because the spectral absorption of the azine dyes themselves are sharp. However, these compounds are serious in color contamination because their color forming efficiencies are low and their color forming reaction does not go all the way. Therefore, a further improvement has been required so far.

SUMMARY OF THE INVENTION

It is an object of the invention to provide a silver halide color photographic light sensitive material which is excellent in color reproducibility and has improved in color forming efficiency and graininess.

The above-mentioned object of the invention can be achieved with a silver halide color photographic light-sensitive material containing at least one kind of magenta couplers represented by the following formula I.

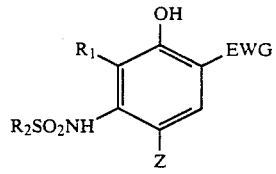

Formula I wherein $R_1$ represents a hydrogen atom or a group being substitutable on a benzene ring: $R_2$ represents a substituted or unsubstituted aryl, alkyl, heterocyclic of amino group: provided, $R_1$ and $R_2$ are allowed to bond together so as to complete a ring: Z represents a hydrogen atom or a group capable of being split off upon coupling reaction with the oxidized products of an aromatic primary amine developing agent: and EWG represents an electron attractive group having a Hammett's $\sigma p$ value of exceeding 0.3.

DETAILED DESCRIPTION OF THE INVENTION

In Formula I, $R_1$ represents a hydrogen atom or any group, provided, the group can be substituted on a benzene ring, $R_1$ represents, more concretely, a halogen atom, a nitro group, a cyano group, an amino group, a sulfo group, a hydroxy group, an alkyl group, an aryl group, an aralkyl group, a cycloalkyl group, an alkoxy group an aryloxy group, an alkylcarbonyloxy group, an arylcarbonyloxy group, a carbamoyloxy group, a carboxyl group, an alkoxycarbonyl group, an aryloxycarbonyl group, a carbamoyl group, an alkylaminocarbonyl group, an arylaminocarbonyl group, an acyl group, an alkoxycarbonylamino group, an acylamino group, a ureido group, an alkylsulfonylamino group, an arylsulfonylamino group, a sulfamoylamino group, an alkylsulfonyl group, an arylsulfonyl group, a sulfamoyl group, an imido group, an alkylthio group, an arylthio group, and a heterocyclic group, $R_2$ represents, more concretely, substituted or unsubstituted aryl groups such as a phenyl group, a naphthyl group, a tolyl group, and 3-nitrophenyl group, a substituted or unsubstituted alkyl groups such as a methyl group, a butyl group, a methoxymethyl group, and a trifluoromethyl group, a substituted or unsubstituted heterocyclic groups such as a furyl group, a pyridyl group, and a thienyl group, and a substituted or unsubstituted amino groups such as a dimethylamino group, a pyrrolidinyl group, a morpholino group, and an anilino group. Among those represented by $R_2$. substituted or unsubstituted phenyl or naphthyl groups are preferable.

The groups given for $R_1$ may also be used as the substituents for $R_2$.

$R_1$ and $R_2$ are also allowed to bond together to complete a ring and, more preferably, a 5- or 6-member ring.

In Formula I, the groups each represented by Z capable of being split off upon coupling reaction with the oxidized products of an aromatic primary amine developing agent. include, for example, halogen atoms such as each atom of chlorine, bromine, and fluorine, and splittable groups whose oxygen, sulfur or nitrogen atom bonds directly to a coupling position of the coupler, such splittable groups include, for example, an alkoxy group, an aryloxy group, a sulfonylalkoxy group, a carbamoyloxy group, a carbamoylmethoxy group, an acyloxy group, a sulfonamido group, a triazolylthio group, a tetraazolylthio group, a tetrazolyl group, a carbonyloxy group, and succinimido group.

Z may also be a photographically usable group PUG or a group capable of releasing a photographically usable group through the so-called timing group.

Such photographically usable groups include, for example, a development inhibitor, a competitive compound, i.e., a scavenger of the oxidized products of a developing agent, a foggant, a desilvering accelerator, a dye, a development accelerator, a silver halide solvent, and a desilvering inhibitor. Among them, a development inhibitor and a competitive compound are preferably used.

EWG represents an electron attractive group having a Hammett's $\sigma p$ value of exceeding 0.3.

EWGs include, for example, a trifluoromethyl group, a cyano group, a formyl group, an acyl group, an alkoxycarbonyl group, an aryloxycarbonyl group, a carbamoyl group, a sulfonyl group, a sulfamoyl group, and a sulfinyl group. Among them, an alkoxycarbonyl, aryloxycarbonyl, carbamoyl, sulfamoyl and sulfonyl groups are preferably used.

Now, the typical cyan couplers represented by Formula I will be exemplified below. It is, however, to be understood that the invention shall not be limited thereto.

In the following formulas, represents a tertiary pentyl group.

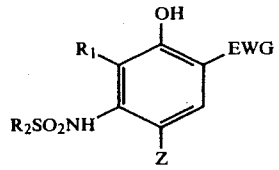
| No. | $R_1$ | $R_2$ | Z | EWG |
|---|---|---|---|---|
| 1 | —H | 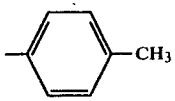 | —H | 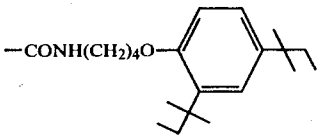 |
| 2 | —H | 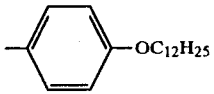 | —H | 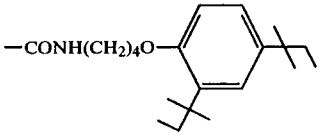 |
| 3 | —H | 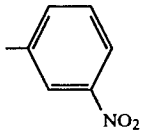 | —H | 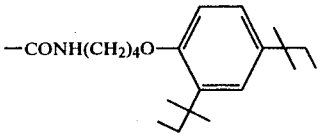 |
| 4 | —H | $-CH_3$ | —H | 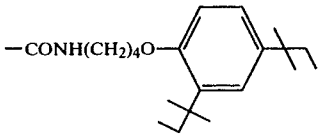 |
| 5 | —H | $-C_4H_9$ | —H | 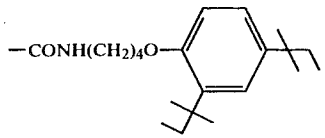 |

-continued
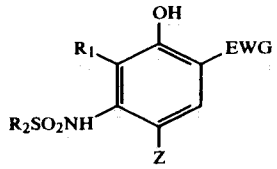
| No. | $R_1$ | $R_2$ | Z | EWG |
|---|---|---|---|---|
| 6 | —H | —$CF_3$ | —H | —$CONH(CH_2)_4O$— 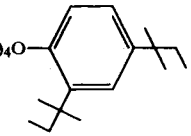 |
| 7 | —H | —$N(CH_3)_2$ | —H | —$CONH(CH_2)_4O$— 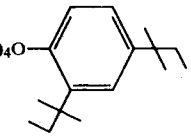 |
| 8 | —H | 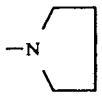 | —H | —$CONH(CH_2)_4O$— 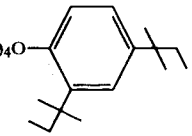 |
| 9 | —H | —$CH_3$ | —Cl | —$CONH(CH_2)_4O$— 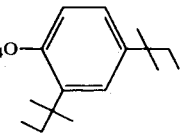 |
| 10 | —$OCH_3$ | 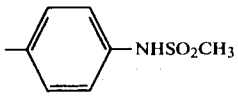 —$NHSO_2CH_3$ | —Cl | —$CONH(CH_2)_4O$— 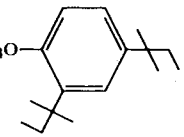 |

-continued
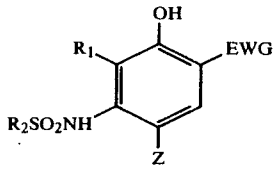
| No. | $R_1$ | $R_2$ | Z | EWG |
|---|---|---|---|---|
| 11 | 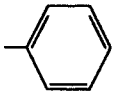 | 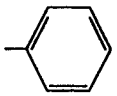 | $-OCH_2CO_2C_2H_5$ | $-CONH(CH_2)_4O-$ 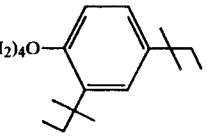 |
| 12 | $-H$ | 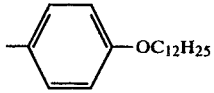  | 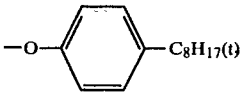  | $-CO_2C_2H_5$ |
| 13 | $-H$ | 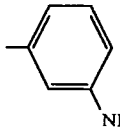  | $-OCH_2CO_2C_6H_{13}$ | $-CO_2C_2H_5$ |
| 14 | $-Cl$ | 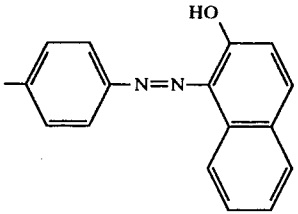  | 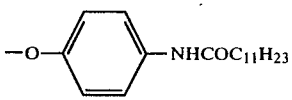  | $-CONHCH_2CH_2CO_2H$ |
| 15 | $-H$ | 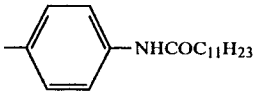  | $-Cl$ | $-SO_2CH_3$ |

-continued
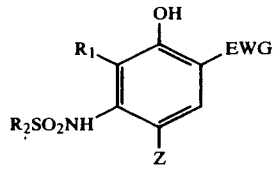
| No. | $R_1$ | $R_2$ | Z | EWG |
|---|---|---|---|---|
| 16 | —H | 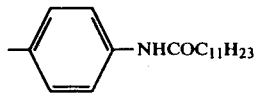 | $-OCH_2CONHC_6H_{13}$ | $-SO_2CH_3$ |
| 17 | $-NHCOC_4H_9(t)$ | 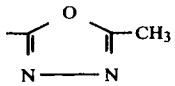 | $-OCH_2CONHC_6H_{13}$ | $-SO_2CH_3$ |
| 18 | —H | $-C_4H_9$ | —H | 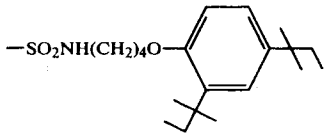 |
| 19 | —H | 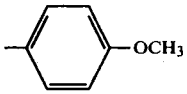 | —H | 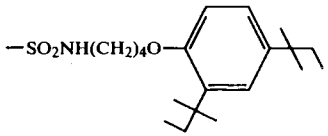 |
| 20 | —Cl | 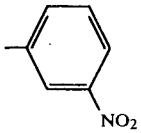 | —Cl | 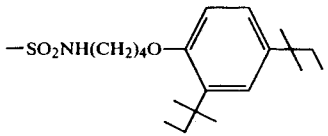 |
| 21 | —Cl | 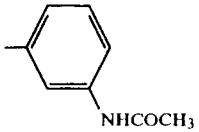 | —Cl | 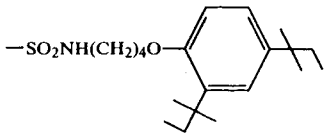 |

-continued
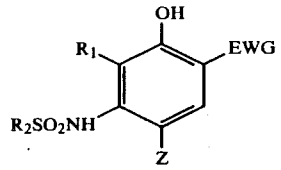
| No. | $R_1$ | $R_2$ | Z | EWG |
|---|---|---|---|---|
| 22 | $-NHCOCF_3$ | 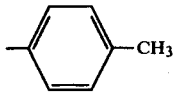 | $-OCH_2CONH(CH_2)_2OH$ | 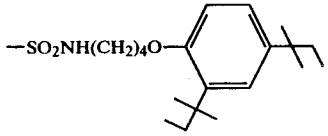 |
| 23 | $-NHCOCF_3$ | 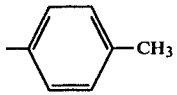 | 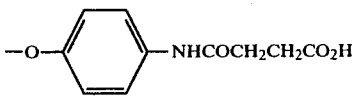 | 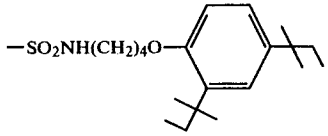 |
| 24 | $-H$ | 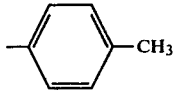 | $-Cl$ | $-COC_{14}H_{29}$ |
| 25 | 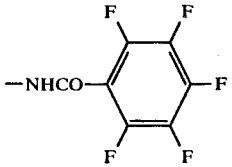 | 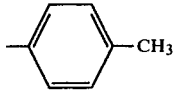 | $-Cl$ | $-COC_{14}H_{29}$ |
| 26 | $-H$ | 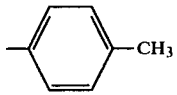 | $-OCH_2CONH(CH_2)_2OCH_3$ | $-CONHC_{14}H_{29}$ |
| 27 | $-Cl$ | 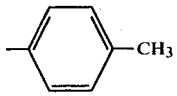 | 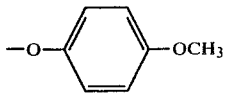 | $-CONHC_{14}H_{29}$ |

-continued
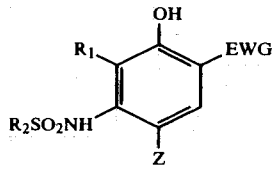
| No. | $R_1$ | $R_2$ | Z | EWG |
|---|---|---|---|---|
| 28 | —H | 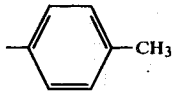 | —H | 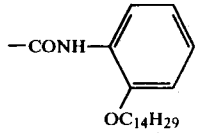 |
| 29 | —H | 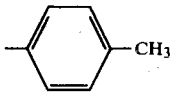 | $-OCH_2CO_2CH_3$ | 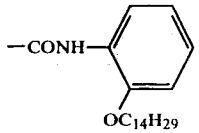 |
| 30 | $-NHCOC_3F_7$ | 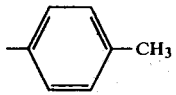 | —H | 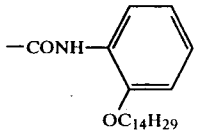 |
| 31 | $-NHCOC_3F_7$ | 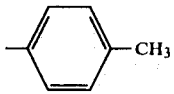 | —Cl | 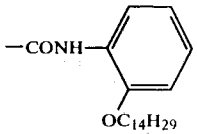 |
| 32 | 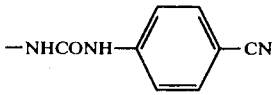 | 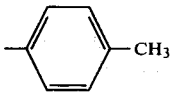 | $-OCH_2CH_2SO_2CH_3$ | 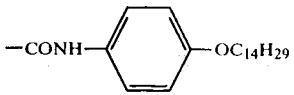 |

-continued
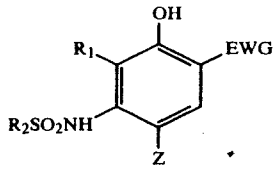
| No. | $R_1$ | $R_2$ | Z | EWG |
|---|---|---|---|---|
| 33 | —H | 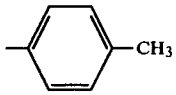 | 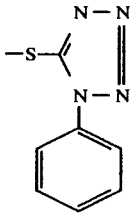 | 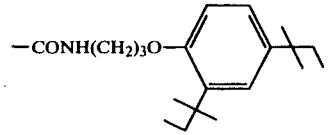 |
| 34 | —H | 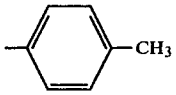 | 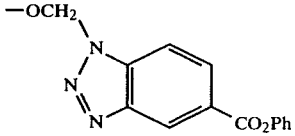 | 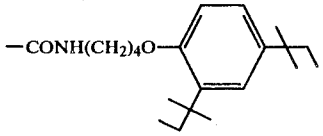 |
| 35 | —H | —$CH_3$ | 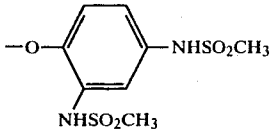 | 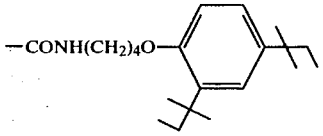 |
| 36 | —H | —$CH_3$ | 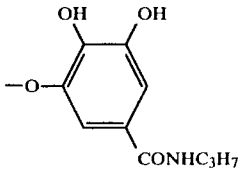 | 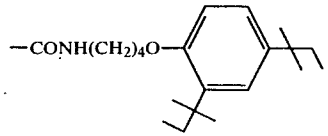 |

-continued
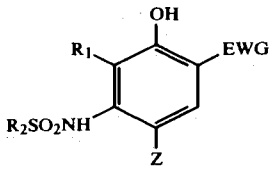
| No. | $R_1$ | $R_2$ | Z | EWG |
|---|---|---|---|---|
| 37 | —H | —N(CH3)2 | 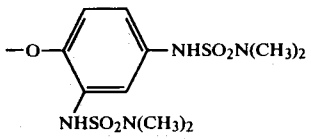 | 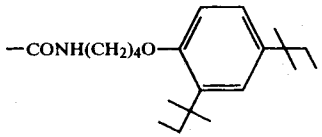 |
| 38 | —H | —CF3 | 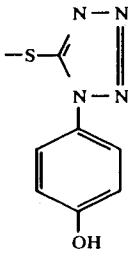 | 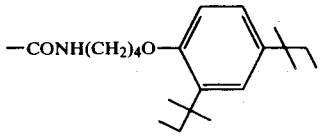 |
| 39 | —H | —CF3 | 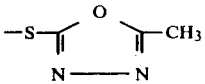 | 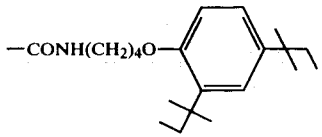 |
| 40 | | 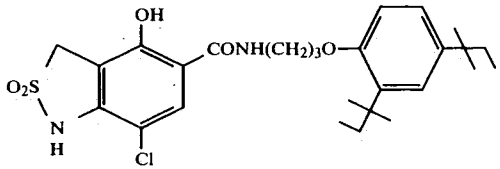 | | |

SYNTHESIS EXAMPLE-1

Syntheses of Exemplified Compounds 4 and 9

According to the following Scheme-1, Exemplified Compounds 4 and 9 were synthesized.

Scheme-1

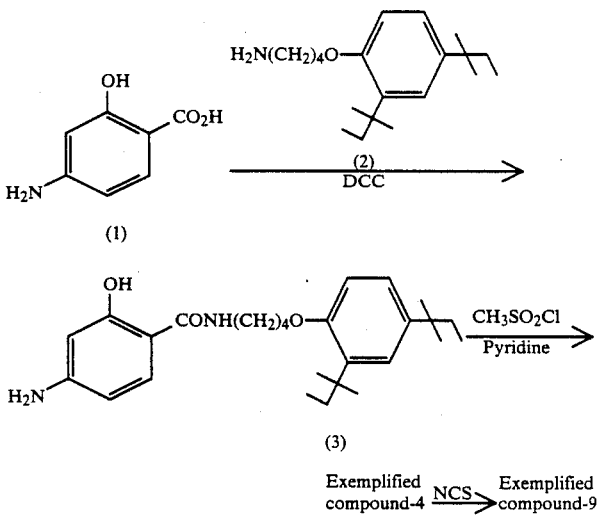

<Synthesis of Intermediate (3)>

A solution was made by dissolving 100 g of 4-aminosalicylic acid (1) and 220 g of 4-(2.4-di-tert-amylphenoxy) butylamine (2) into I liter of dioxane. While the resulting solution was being stirred at room temperature, the solution was dropped thereinto with a solution prepared by dissolving 135g of dicyclohexylcarbodiimide (DCC) into 200 ml of dioxane.

After dropped, a stirring was continued for 3 hours at room temperature, and the deposited urea was separated through filtration. The resulting filtrate was distilled off under reduced pressure and a recrystallization was made from 600 ml of hexane, so that 240 g of the intermediate (3) was obtained.

<Synthesis of Exemplified Compound-4>

A solution was made by dissolving 35.2 g of intermediate (3) and 11.0 g of methanesulfonyl chloride into 200 ml of ethyl acetate and, whereto 7.6 g of pyridine was added. The resulting solution was refluxed by heating for 5 hours with stirring. After completing a reaction, the reactant was washed with dilute hydrocloric acid and water and was then dehydrated with magnesium sulfate. After then, ethyl acetate was distilled off under reduced pressure from the remaining matter. The residues were separated therefrom to be refined by a silica-gel chromatography using an ethyl acetate-hexane developing solvent and were successively recrystallized from the solvent of an ethyl acetate-hexane mixture. Thereby 28.2 g of crystals having a melting point of 151 to 153° C. were obtained.

The resulting crystal were confirmed to be Exemplified Compound-4 by an NMR and an FAB MS.

<Synthesis of Exemplified Compound-9>

A solution was made by dissolving 14.1 g of Exemplified Compound-4 into 100 ml of ethyl acetate and thereto 4.1 g of N-chlorosuccinimide NCS was further added. The resulting solution was kept being stirred for 8 hours at room temperature and, after completing a reaction, it was washed with water and the organic phase thereof was condensed by drying.

The resulting condensate was separated to be refined through a silica-gel chromatography using an ethyl acetate-hexane developing solvent and, thereby 14.2 g of amorphous powder was obtained.

The resulting powder was confirmed to be Exemplified Compound-9 through an NMR and an FAM-MS.

EXAMPLES

In all the examples given below, an amount of any substances added into a silver halide photographic light-sensitive material is indicated by an amount thereof per sq. meter, and an amount of silver halides is indicated in terms of a silver content.

EXAMPLE 1

A multilayered color photographic element was prepared by coating each layer having the following composition over a triacetyl cellulose film support, in order from the support side.

<Sample-1>

( Layer-1 : An antihalation layer HCA-1

A gelatin layer containing black colloidal silver Layer-2 : An interlayer I.L.

A gelatin layer containing an emulsified dispersion of 2,5-di-t-octylhydroquinone Layer-3 : A low-speed red-sensitive silver halide emulsion layer RL-1

Monodispersed emulsion Em-I having an average grain size $\bar{r}$ of 0.30 μm and comprising AgBrI containing AgI of 6.0 mol%

Amount of silver coated: 1.8 g/m$^2$ Sensitizing dye I $6\times10^{-5}$ mols per mol of silver Sensitizing dye II $1.0\times10^{-5}$ mols per mol of silver Cyan coupler C-I 0.06 mols per mol of silver Colored cyan coupler CC-1

0.003 mols per mol of silver DIR compound D-2

0.0015 mols per mol of silver DIR compound D-2

0.002 mols per mol of silver High boiling solvent HBS-1

0 8 g/m²

Layer-4 : A high-speed red-sensitive silver halide emulsion layer RH-1

Monodispersed emulsion Em-II having an average grain-size $\bar{r}$ of 0.5 μm and comprising AgBrI containing AgI of 7.0 mol%

An amount of silver coated: 1.3 g/m² Sensitizing dye I $3\times10^{-5}$ mols per mol of silver Sensitizing dye II $1.0\times10^{-5}$ mols per mol of silver Cyan coupler C-1

0.03 mols per mol of silver DIR compound D-2

0.001 mols per mol of silver High boiling solvent HBS-1

0.32 g/m²

Layer-5 : An interlayer I.L.

The same gelatin layer as Layer-2

Layer-6 : A low-speed green-sensitive silver halide emulsion layer GL-1

Em−1 An amount of silver coated: 1.5 g/m²

Sensitizing dye III $25\times10^{-5}$ mols per mol of silver Sensitizing dye IV $1.2\times10^{-5}$ mols per mol of silver Magenta coupler M-1 0.045 mols per mol of silver Colored magenta coupler CM-1 0.009 mols per mol of silver DIR compound D-1 0.0010 mols per mol of silver DIR compound D-3 0.0030 mols per mol of silver High boiling solvent HBS-1 0.91 g/m²

Layer-7 : A high-speed green-sensitive silver halide emulsion layer GH-1

Em-II An amount of silver coated: 1.4 g/m²

Sensitizing dye III $1.5\times10^{-5}$ mols per mol of silver

Sensitizing dye IV $1.0\times10^{-5}$ mols per mol of silver Magenta coupler M-1

0.030 mols per mol of silver

DIR compound D-3

0.0010 mols per mol of silver

High boiling solvent HBS-1

0.44 g/m²

Layer-8 : A yellow filter layer YC-1

A gelatin layer containing yellow colloidal silver and an emulsified dispersion of 2,5-di-t-octylhydroquinone Layer-9 : AS low-speed blue-sensitive silver halide emulsion layer BL-1

Polydispersed emulsion Em-III having an average grain-size $\bar{r}$ of 0.48 μm and comprising AgBrI containing AgI of 6.0 mol%

An amount of silver coated: 0.9 g/m²

Sensitizing dye V $1.3\times10^{-5}$ mols per mol of silver

Yellow coupler YY-1

0.29 mols per mol of silver

High boiling solvent HBS-2

0.20 g/m²

Layer 10: A high speed blue-sensitive silver halide emulsion layer BH-1

Polydispersed emulsion Em-IV having an average grain-size $\bar{r}$ of 0.8 μm and comprising AgBrI containing AgI of 15 mol%

An amount of silver coated: 0.5 g/m² Sensitizing dye V $1.0\times10^{-5}$ mols per mol of silver Yellow coupler YY-1

0.08 mols per mol of silver

DIR compound D-2

0.0015 mols per mol of silver

High boiling solvent HBS-2

0.08 g/m²

Layer-11: A first protective layer P-1

A gelatin layer containing silver iodobromide grains having an average size $\bar{r}$ of 0.07 μm and containing AgI of I mol%

An amount of silver coated: 0.5 g/m², and

UV absorbents UV-1 and UV-2

Layer-12: A second protective layer P-2

A gelatin layer containing polymethyl methacrylate particles having a particle-size of 1.5 μm, and formalin scavenger HS-1

Besides the above, gelatin hardener H-1 and a surfactant were further added to each layer.

The layer thicknesses of Layer-1 through Layer-12 were 22 μm and the amounts of silver coated thereof were 7.4 g/m² in total.

<Samples-2 to 9>

Samples-2 through 9 each were prepared in the same manner as in Sample-1, except that magenta coupler M-1 added into Layer-6 of Sample-1 was replaced by the couplers shown in Table 1.

The compounds incorporated into each layer of Samples-1 through 9, except those already described above, will be listed below.

Sensitizing dye I:

5,5'-dichloro-9-ethyl-3,3'-di-(3-sulfopropyl)-thiacarbocyanine hydroxide

Sensitizing dye II:

9-ethyl-3,3'-di-(3-sulfopropyl)-4,5,4',5'-dibenzothiacarbocyanine hydroxide

Sensitizing dye III:

5,5'-diphenyl-9-ethyl-3,3'-di-(3-sulfopropyl)-oxacarbocyanine hydroxide

Sensitizing dye IV:

9-ethyl-3,3'-di-(3-sulfopropyl)-5,6,5',6'-dibenzooxacarbocyanine hydroxide Sensitizing dye V:

3,3'-di-(3-sulfopropyl)-4,5-benzo-5'-methoxythiacyanine

C-1

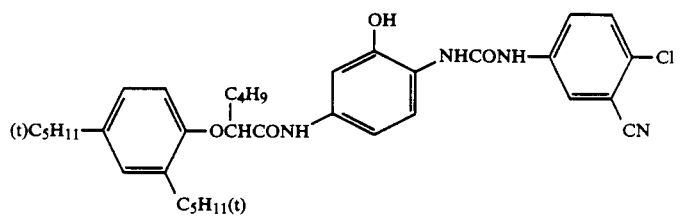

-continued
CC-1
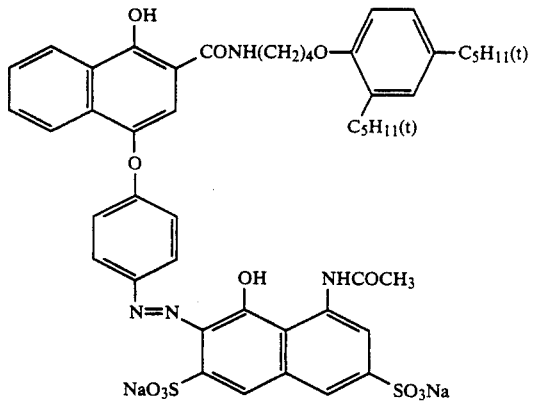
D-1
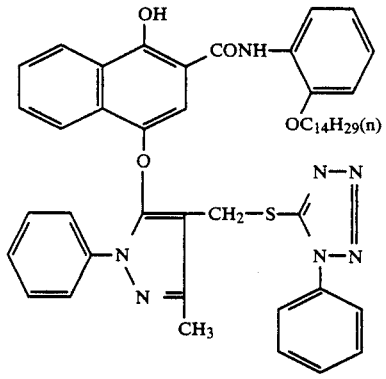
D-2
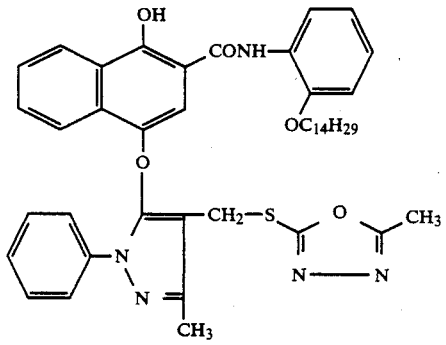
D-3
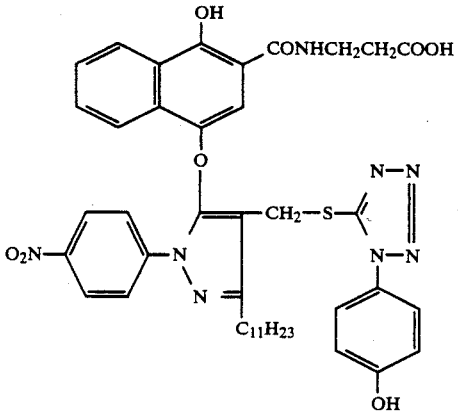

-continued
M-1
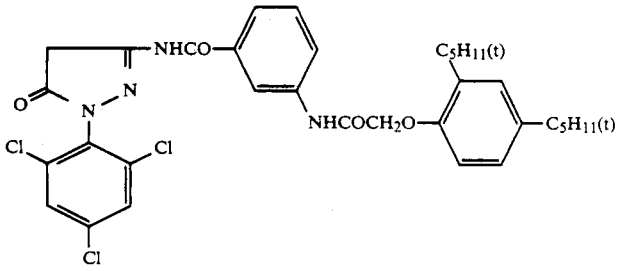
M-2
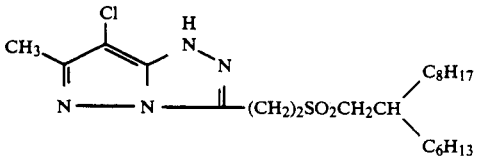
M-3
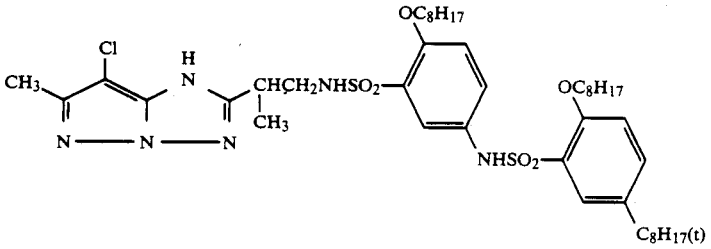
CM-1
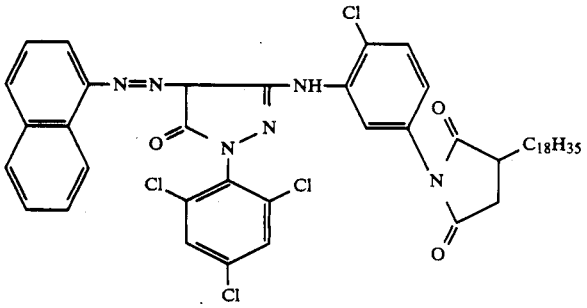
YY-1
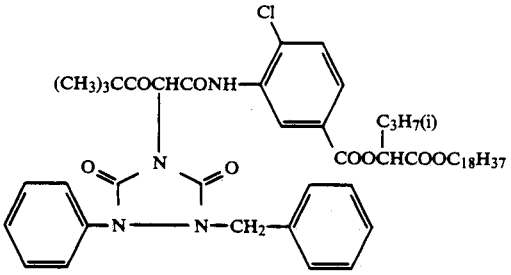
UV-1
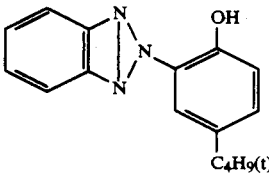
UV-2
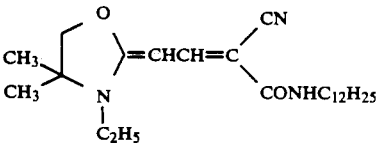

-continued

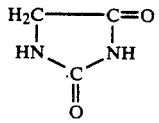

HS-1

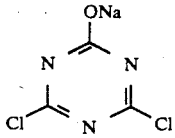

H-1

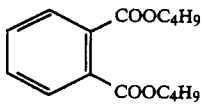

HBS-1

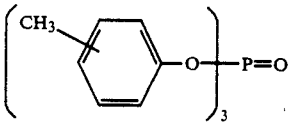

HBS-2

Samples-1 through 9 thus prepared were each exposed through an optical wedge to light and were then processed in the following processing steps.

| Processing step (carried out at 38° C.) | |
|---|---|
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

The compositions of the processing solutions used in the above processing steps were as follows.

| | |
|---|---|
| <Color developer> | |
| 4-amino-3-methyl-N-ethyl-N-(β-hydroxyethyl)-aniline sulfate | 4.75 g |
| Sodium sulfite, anhydrous | 4.25 g |
| Hydroxylamine ½ sulfate | 2.0 g |
| Potassium carbonate, anhydrous | 37.5 g |
| Sodium bromide | 1.3 g |
| Trisodium nitrilotriacetate, monohydrate | 2.5 g |
| Potassium hydroxide | 1.0 g |
| Add water to make | 1 liter |
| <Bleaching solution> | |
| Ferric-ammonium ethylenediaminetetraacetate | 100.0 g |
| Diammonium ethylenediaminetetraacetate | 10.0 g |
| Ammonium bromide | 150.0 g |
| Glacial acetic acid | 10.0 ml |
| Add water to make | 1 liter |
| Adjust pH with aqueous ammonia to | pH = 6.0 |
| <Fixer> | |
| Ammonium thiosulfate | 175.0 g |
| Sodium sulfite, anhydrous | 8.5 g |
| Sodium metasulfite | 2.3 g |
| Add water to make | 1 liter |
| Adjust pH with acetic acid to | pH = 6.0 |
| <Stabilizer> | |
| Formalin in a 37% aqueous solution | 1.5 ml |
| Konidux manufactured by Konica Corp. | 7.5 ml |
| Add water to make | 1 liter |

With respect to the resulting samples, the maximum density Dm, relative sensitivity, and graininess RMS thereof were each measured. The results thereof are shown in Table-1.

The RMS values are indicated by a value 1000 times as much as a standard deviation of density value variations found when a portion of sample having the density of a minimum density +1.2 is scanned with a microdensitometer having a 25-μm circular scanning aperture.

TABLE 1

| Sample No. | Coupler added to Layer-6 | Relative sensitivity Note(1) | $Dm_G$ Note(2) | $RMS_G$ Note(3) |
|---|---|---|---|---|
| 1 Comparative | M-1 | 100 | 2.58 | 29 |
| 2 Comparative | M-2 | 92 | 2.50 | 38 |
| 3 Comparative | M-3 | 86 | 2.32 | 35 |
| 4 Invention | Exemplified compound-3 | 106 | 2.73 | 16 |
| 5 Invention | Exemplified compound-7 | 103 | 2.60 | 14 |
| 6 Invention | Exemplified compound-9 | 112 | 2.91 | 24 |
| 7 Invention | Exemplified compound-20 | 108 | 2.79 | 23 |
| 8 Invention | Exemplified compound-22 | 114 | 2.83 | 20 |
| 9 Invention | Exemplified compound-29 | 116 | 2.82 | 19 |

Note(1) Expressed in a value relative to the sensitivity of Sample-1 regarded as a value of 100.
Note(2) A maximum density Dm of the magenta image-forming layers
Note(3) RMS of the magenta image-forming layers As is obvious from the results shown in Table-1, it is found that Samples-4 through 9 each are superb color light-sensitive materials because each of them displays high-leveled sensitivity, Dm, and graininess.

EXAMPLE 2

This example was embodied by applying the invention to a color photographic paper.

<Preparation of Silver Halide Emulsion>

Three kinds of silver halide emulsions shown in Table-2 were prepared in a neutral double-jet method.

TABLE 2

| Emulsion No. | AgCl % | AgBr % | Average grain-size μm | Chemical sensitizer | Spectro-sensitizing dye |
|---|---|---|---|---|---|
| Em-1 | 100 | 0 | 0.67 | Sodium thio-sulfate*1 | SD-1*3 |
| Em-2 | 99.5 | 0.5 | 0.46 | Chloroauric acid*2 | SD-2*4 |
| Em-3 | 99.5 | 0.5 | 0.43 | | SD-3*5 |

*1Added 2 mg per mol of silver halide
*2Added $5 \times 10^{-5}$ mols per mol of silver halide
*3Added 0.9 mmols per mol of silver halide
*4Added 0.7 mmols per mol of silver halide
*5Added 0.2 mmols per mol of silver halide Spectrosensitizing dyes used therein were shown below.

SD-1

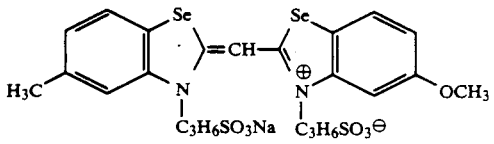

SD-2

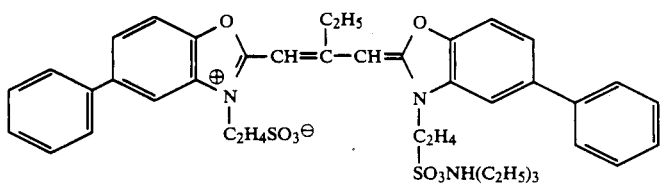

SD-3

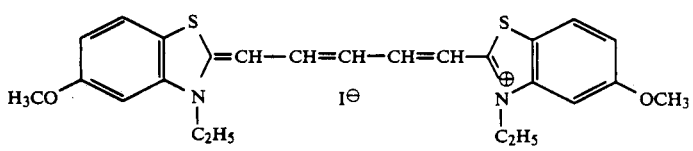

After completing the chemical sensitization of each silver halide emulsion, STB-1 having the following formula was added in an amount of $5 \times 10^{-3}$ mols thereinto to serve as an emulsion stabilizer.

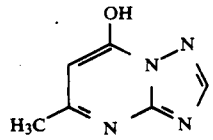

<Preparation of Silver Halide Color Photographic Light-sensitive Material Sample>

A silver halide color photographic light-sensitive material Sample-10 was prepared in such a manner that the following layers 1 through 7 were coated one after another to a paper support coated on the both sides with polyethylene in a simultaneous multilayer coating method. In the following example, an amount of the materials added is expressed in the amount per sq. meter of the light-sensitive material used.

Layer-1 . . . A layer containing 1.2 g of gelatin 0.29 g (in the terms of silver contents, and so forth) of a blue-sensitive silver halide emulsion Em-1: and 0.3 g of dinonyl phthalate DNP in which 0.75 g of yellow coupler YY-2. 0.3 g of image stabilizer ST-1 and 0.015 g of 2,5-dioctylhydroquinone HQ-1 were dissolved together.

Layer-2 . . . A layer containing 0.9 g of gelatin and 0.2 g of dioctyl phthalate DOP in which 0.04 g of HQ-1 was dissolved.

Layer-3 . . . A layer containing 1.4 g of gelatin: 0.2 g of green-sensitive silver halide emulsion Em-2; 0.5 g of DOP in which 0.9 mmols of magenta coupler MM-1, 0.25 g of image stabilizer ST-2 and 0.01 g of HQ-1 were dissolved together; and 6 mg of the following filter dye AI-1.

Layer-4 . . . A layer containing 1.2 g of gelatin and 0.3 g of DNP in which 0.6 g of the following UV absorbent UV-3 and 0.05 g of HQ-1 were dissolved together.

Layer-5 . . . A layer containing 1.4 g of gelatin; 0.20 g of red-sensitive silver halide emulsion Em-3: and 0.3 g of DOP in which 0.4 g of cyan coupler PC-1, 0.2 g of cyan coupler PC-2, 0.01 g of HQ-1, and 0.3 g of ST-1 were dissolved together.

Layer-6 . . . A layer containing 1.1 g of gelatin: 0.2 g of DOP in which 0.2 g of UV-3 was dissolved: and 5 mg of filter dye AI-2.

Layer-7 . . . A layer containing 1.0 g of gelatin and 0.05 g of sodium 2,4-dichloro-6-hydroxytriazine.

Further, Samples-11 and 12 were each prepared in the same manner as in Sample-10, except that the magenta coupler MM-1 of Layer-3 was replaced by the exemplified compounds shown in Table-3, respectively.

The compounds used in these samples are given as follows.

ST-1

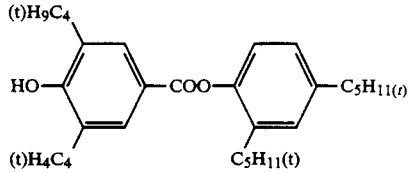

-continued
ST-2
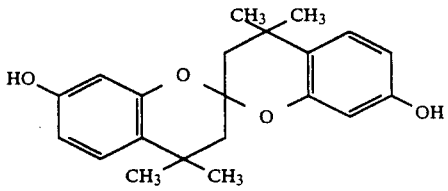
UV-1
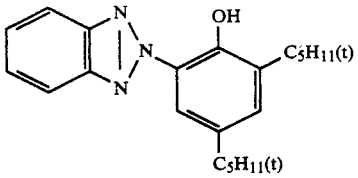
AI-1
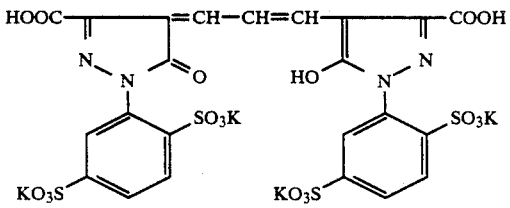
AI-2
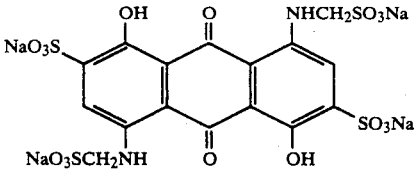
YY-1
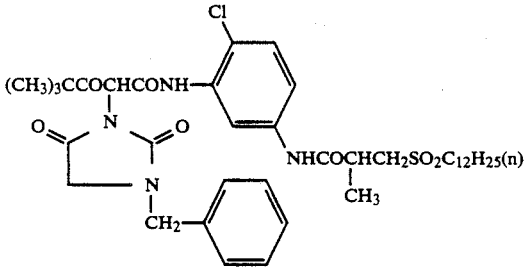
MM-1
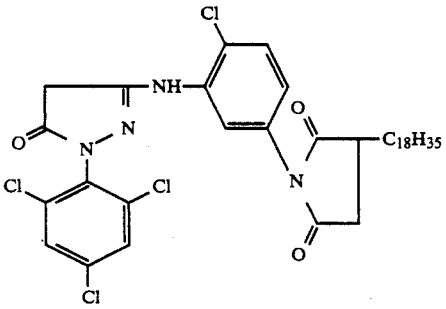
PC-1
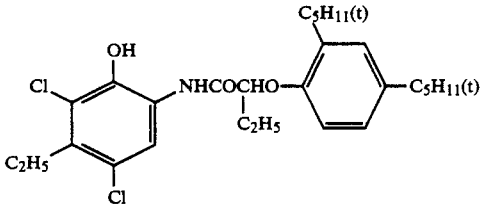

-continued

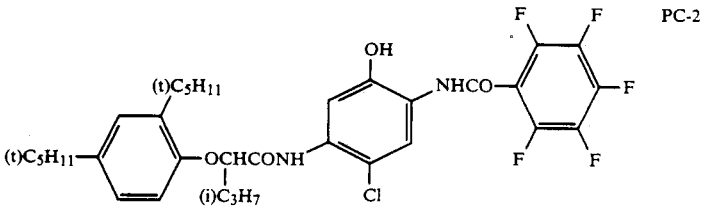

With respect to the resulting samples-10 through 12 the color reproducibilities thereof were evaluated in the following manner.

First, using a color negative film. Konica Color SR V-100 manufactured by Konica Corporation, and a camera. Konica FT-1 Motor manufactured by Konica Corporation, a color-checker manufactured by Macbeth Company was photographed and was then processed in a color-negative development process CNK-4 formulated by Konica Corporation. The resulting negative image was printed in a size of 82×117 mm on each of Samples-10 through 12, by making use of a Sakura Color Printer CL-P2000 manufactured by Konica Corporation, and the practical prints were obtained in the following processing steps by making use of the following color developer, bleach-fixer, and stabilizer. When printing, the printing conditions were determined by every sample so as to make the grey color on the color-checker to be the same grey color on the prints.

With respect to the resulting practical prints, the color reproducibilities thereof were evaluated. The results thereof are collectively shown in Table-3.

| | |
|---|---|
| <Color developer> | |
| Pure water | 800 ml |
| Triethanolamine | 8 g |
| N,N-diethylhydroxyamine | 5 g |
| Potassium chloride | 2 g |
| N-ethyl-N-β-methanesulfonamidoethyl-3-methyl-4-aminoaniline sulfate | 5 g |
| Sodium tetrapolyphosphate | 2 g |
| Potassium carbonate | 30 g |
| Potassium sulfite | 0.2 g |
| Fluorescent brightening agent, 4,4'-diaminostilbenedisulfonic acid derivative | 1 g |
| Add pure water to make in total of | 1 liter |
| Adjust pH to be | pH = 10.2 |
| <Bleach-Fixer> | |
| Ferric ammonium ethylenediamine tetraacetate, dihydrate | 60 g |
| Ethylenediaminetetraacetic acid | 3 g |
| Ammonium thiosulfate, in a 70% gaueous solution | 100 ml |
| Ammonium sulfite, in a 40% aqueous solution | 27.5 ml |
| Adjust pH with potassium carbonate or glacial acetic acid to be | pH = 5.6 |
| Add water to make in total of | 1 liter |
| <Stabilizer> | |
| 5-chloro-2-methyl-4-isothiazoline-3-one | 1 g |
| 1-hydroxyethylidene-1,1-diphosphoric acid | 2 g |
| Add water to make | 1 liter |
| Adjust pH with sulfuric acid or potassium hydroxide to be | pH = 7.0 |

| | Temperature | Time |
|---|---|---|
| <Processing Step> | | |
| Color developing | 34.7 ± 0.3° C. | 45 sec. |
| Bleach-fixing | 34.7 ± 0.5° C. | 50 sec. |
| Stabilizing | 30 to 34° C. | 90 sec. |

-continued

| | | |
|---|---|---|
| Drying | 60 to 80° C. | 60 sec. |

TABLE 3

| Sample No. | Coupler | Color reproducibility | | | | | |
|---|---|---|---|---|---|---|---|
| | | Blue | Green | Red | Yellow | Magenta | Cyan |
| 10 | Comparative coupler MM-1 | P | G | P | G | P | G |
| 11 | Exemplified compound 9 | E | G | E | G | E | G |
| 12 | Exemplified compound 26 | E | G | E | G | E | G |

E: Excellent in color reproducibility
G: Good in color reproducibility
P: Poor in color reproducibility As is also obvious from Table-3, it was confirmed that Samples-11 and 12 having used the compounds of the invention remarkably improved in color reproducibilities to blue, red and magenta colors.

What is claimed is

1. A silver halide photographic light-sensitive material comprising a magenta coupler represented by the following Formula I:

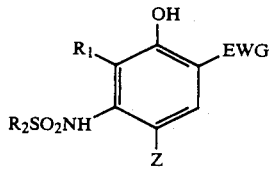

(I)

wherein $R_1$ is a hydrogen atom or a substituent; $R_2$ is a substituted or unsubstituted aryl group, a substituted or unsubstituted alkyl group, a substituted or unsubstituted heterocyclic group or a substituted or unsubstituted amino group; provided, $R_1$ and $R_2$ are allowed to bond together so as to complete a ring; Z is a hydrogen atom or a group capable of being split off upon coupling reaction with the oxidized product of a an aromatic primary amine developing agent; and EWG is an electron attractive group having a Hammet's $\sigma p$ value of more than 0.3.

2. The material of claim 1, wherein said $R_1$ is a hydrogen atom, a halogen atom, a nitro group, a cyano group, an amino group, a sulfo group, a hydroxy group, an alkyl group, an aryl group, an aralkyl group, a cycloalkyl group, an alkoxy group, an aryloxy group, an alkylcarbonyloxy group, an arylcarbonyloxy group, a carbamoyloxy group, a carboxy group, an alkoxycarbonyl group, an aryloxycarbonyl group, a carbamoyl group, an alkylamino carbony group, an arylaminocarbonyl group, an acyl group, an alkoxycarbonylamino group, an acylamino group, a ureido group, an alkylsulfonylamino group, an arylsulfonylamino group, a sulfamoylamino group, an alkylsulfonyl group, an arylsulfonyl group, a sulfamoyl group, an imido group, an alkylthio group, an arylthio group or a heterocyclic group.

3. The material of claim 1, wherein said $R_2$ is a substituted or unsubstituted pheny group or a substituted or unsubstituted naphthyl group.

4. The material of claim 1, wherein said Z is a halogen atom, an alkoxy group, an aryloxy group, a sulfonylalkoxy group, a carbamoyloxy group, a carbamoylmethoxy group, an acyloxy group, a sulfonamido group, a triazolylthio group, a tetrazolylthio group, a tetrazolyl group, a carbonyloxy group or a succinimido group.

5. The material of claim 1, wherein said EWG is a tritluoromethyl group, a cyano group, a formyl group, an acyl group, an alkoxycarbonyl group, an aryloxycarbonyl group, a carbamoyl group, a sulfonyl group, a sulfamoyl group or a sulfinyl grop.

6. The material of claim 5, wherein said EWG is an alkoxycarbonyl group, an aryloxycarbonyl group, a carbamoyl group, a sulfamoyl group or a sulfonyl group.

* * * * *